US006450729B1

(12) United States Patent
Clapp

(10) Patent No.: US 6,450,729 B1
(45) Date of Patent: Sep. 17, 2002

(54) PAVEMENT SURFACE CRACK REPAIR METHOD

(76) Inventor: Daniel C. Clapp, 24 Maple Ave., Fair Haven, NJ (US) 07704

( * ) Notice: Subject to any disclaimer, the term of this patent is extended or adjusted under 35 U.S.C. 154(b) by 0 days.

(21) Appl. No.: 09/481,849

(22) Filed: Jan. 14, 2000

(51) Int. Cl.[7] ..... B01C 7/06; E02D 37/00

(52) U.S. Cl. ..... 404/75; 52/514; 52/514.5; 52/746.1

(58) Field of Search ..... 404/72, 75, 47, 404/56, 64, 67, 69; 14/73.1; 52/514, 514.5, 746.1

(56) References Cited

U.S. PATENT DOCUMENTS

| | | | | |
|---|---|---|---|---|
| 3,663,350 A | | 5/1972 | Stokes | |
| 3,932,051 A | | 1/1976 | Cleary | |
| 3,993,412 A | | 11/1976 | Drane | |
| 4,113,401 A | | 9/1978 | McDonald | |
| 4,265,563 A | | 5/1981 | Marzocchi et al. | |
| 4,668,548 A | | 5/1987 | Lankard | |
| 4,793,162 A | * | 12/1988 | Emmons | 404/69 |
| 5,185,013 A | | 2/1993 | Martin | |
| 5,464,304 A | | 11/1995 | Dittmar | |
| 5,513,925 A | * | 5/1996 | Dempsey et al. | 404/17 |
| 5,630,677 A | * | 5/1997 | Barroso | 404/75 |
| 5,749,674 A | * | 5/1998 | Wilson, Sr. | 404/75 |
| 6,074,128 A | * | 6/2000 | Marino | 404/75 |

* cited by examiner

*Primary Examiner*—Gary S. Hartmann
(74) *Attorney, Agent, or Firm*—Young & Basile, PC

(57) ABSTRACT

A crack repair method for pavement and recreational surfaces includes a slip layer formed over a filled crack which prevents the adhesion of at least one stretchable sheet to the crack while wider outer edges of the sheet are bonded to the top pavement surface. Optionally a second wider stretchable sheet is adhesively applied over the first sheet. Outer edges of the uppermost stretchable sheet are optionally covered by fiberglass fabric strips. In one aspect, the slip layer is formed of one or more tape strips adhesively joined on one side to the filled crack and to the top surface of the pavement surrounding the filled crack. In another aspect, a slip layer having a non-adherable, exposed surface is carried on the bottom surface of the first sheet, with the first sheet adhered at outer side edges extending outward beyond the side edges of the slip layer to the top surface of pavement surrounding the filled crack by an adhesive layer applied over the top surface of the crack and for a distance beyond the side edges of the crack. The strips and the sheets of stretchable material progressively increase in width and length in the stack buildup.

17 Claims, 2 Drawing Sheets

PAVEMENT SURFACE CRACK REPAIR METHOD

BACKGROUND OF THE INVENTION

1. Field of the Invention

This invention relates, in general, to methods for repairing cracks in pavement and recreational surfaces.

2. Description of the Art

Methods for repairing cracks in paving materials, such as roadways, pavement and other concrete or asphalt surfaces, such as recreational surfaces, tennis courts, outdoor basketball courts, volleyball courts and running tracks, generally involve cleaning the crack of loose debris and then filling the crack with a crack filler material which hardens to a solid state forming a smooth surface with the surrounding pavement surface. This is more economical than re-paving the entire section of pavement which may contain only one or a few cracks.

However, such a crack repair method is viewed as only a temporary repair as progressive maintenance must be applied due to continued crack enlargement under changing environmental conditions, including temperature and moisture fluctuations. Repaired cracks continue to expand since current repair methods do not alleviate the stresses which cause crack formation or movement.

In an attempt to lengthen the repair times between maintaining a repaired crack in a pavement or other surface, a strong surface has been applied or formed above the repaired crack, typically of an adhesive impregnated fiberglass sheet. However, the fiberglass sheet, while presenting a solid, hard surface, is also susceptible to tears and cracks caused by enlargement or movement of the underlying repaired crack.

In an attempt to address this problem, other crack repair methods have been developed which utilize a so-called "slip-sheet" principle. In these methods, after the crack is cleaned and filled with a crack filler to the surface level of the surrounding pavement or recreational surface, a slip-sheet which can be adhered to the top surface of the crack filler but which presents a nonadhesive outer surface is applied over the crack. One layer of sheet material, was applied over the slip-sheet and adhered at peripheral edges to the surrounding pavement or recreational surface. This isolates the sheet from the slip-sheet thereby enabling the slip-sheet to move with crack movement or enlargement without generating stresses in the outermost sheet which could tear or rip the outer sheet. Several of these previously devised crack repair methods make use of adhesive-back tape, such as duct tape, which has a non-adhering polyethylene outer surface.

The present Applicant had devised a crack repair method utilizing two 2-inch wide duct tape strips which are applied side edge to side edge over a cleaned and filled crack. In some applications, Applicant used a single 3-inch wide strip of duct tape. The plastic backing of the duct tape prevents adherence to overlaying sheets. The Applicant applied an adhesive layer over and beyond the duct tape for a predetermined width outside of the outer periphery of the tape strips before applying a single 9-inch wide sheet of stretchable fabric. Another wider area of adhesive was applied over the stretchable fabric sheet for adhering a second, wider stretchable fabric sheet of approximately twice the width as the first fabric sheet. After adhesive is applied to the edges of the outermost stretchable fabric sheet, two 6-inch wide strips of fiberglass sheet were applied to the side edges of the outermost stretchable sheet.

While Applicant's prior crack repair method significantly lengthened the time between required maintenance to a repaired crack, the method still experienced failures caused by crack reformation.

Thus, it would be desirable to provide an improved pavement crack repair method which significantly reduces the reformation of repaired cracks in pavement or other surfaces. It would also be desirable to provide an improved crack repair method which returns the pavement or recreational surface to a substantially uniform use surface.

SUMMARY OF THE INVENTION

The present invention is a crack repair method for repairing cracks in pavement which provides a slip-sheet between the filled crack and an overlaying stretchable fabric layer wherein the fabric layer is capable of stretching under stresses induced by crack growth and reformation without rupturing the crack repair patch.

According to one aspect of the present crack repair method, the method is devised for repairing cracks in a pavement and comprises the steps of:

cleaning the crack of debris;

filling the crack with a crack filler hardenable to a solid state;

applying a slip layer over the filled crack and beyond the crack, the slip layer being greater than about four inches wide with one surface adhesively fixed to the filled crack and an opposed non-adherable surface facing away from the filled crack;

applying a first adhesive layer over the slip layer and a first distance beyond opposed side edges of the slip layer; and applying a first sheet of stretchable material over the first adhesive layer.

Optionally, the method further includes the steps of:

applying a second adhesive layer over the first sheet of stretchable material and to a second distance beyond the edges of the first sheet of stretchable material; and applying a second sheet of stretchable material over the second adhesive layer to the full second distance of application of the second adhesive layer.

In another aspect, the method further includes the steps of:

applying a third adhesive layer over the second sheet to a third distance beyond the second flexible sheet; and applying two outermost strips over the edges of the second sheet wherein the portions of the outermost strips are bonded to the second sheet and to the top surface of the pavement beyond the side edges of the second sheet.

Preferably, the first and second sheets are formed of stitch bonded polyester material. The two outermost strips are preferably formed of fiberglass fabric.

In one aspect of the invention, the slip layer is formed of a single layer of an adhesive back tape in a single width strip or two or more side-by-side strips.

In another aspect of the invention, the slip layer is formed by a sheet of plastic material, such as polyethylene, Mylar, Teflon, etc., which is carried on the bottom surface of the first stretchable sheet and overlays the crack when the first sheet is centered over the crack. The outer side edges of the first sheet are fixed to the top surface of the pavement surrounding the crack and beyond the outer edges of the plastic sheet by an adhesive layer previously applied over the filled crack for a predetermined distance beyond the edges of the crack to the full width of the first sheet.

The crack repair method of the present invention overcomes deficiencies found in previously devised crack repair methods for pavement and other recreational surfaces by providing a long life crack repair patch which allows stretching or elongation of the stretchable fabric which is isolated from the filled crack by a slip layer so as to be isolated from stresses created by crack growth and/or reformation.

The crack repair method of present invention provides a crack repair which minimizes tearing of the repair materials. In this way, the crack repair patch remains effective for a longer period of time thereby enabling the pavement or recreational surface to be used for its intended purpose without deterioration of the surface.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
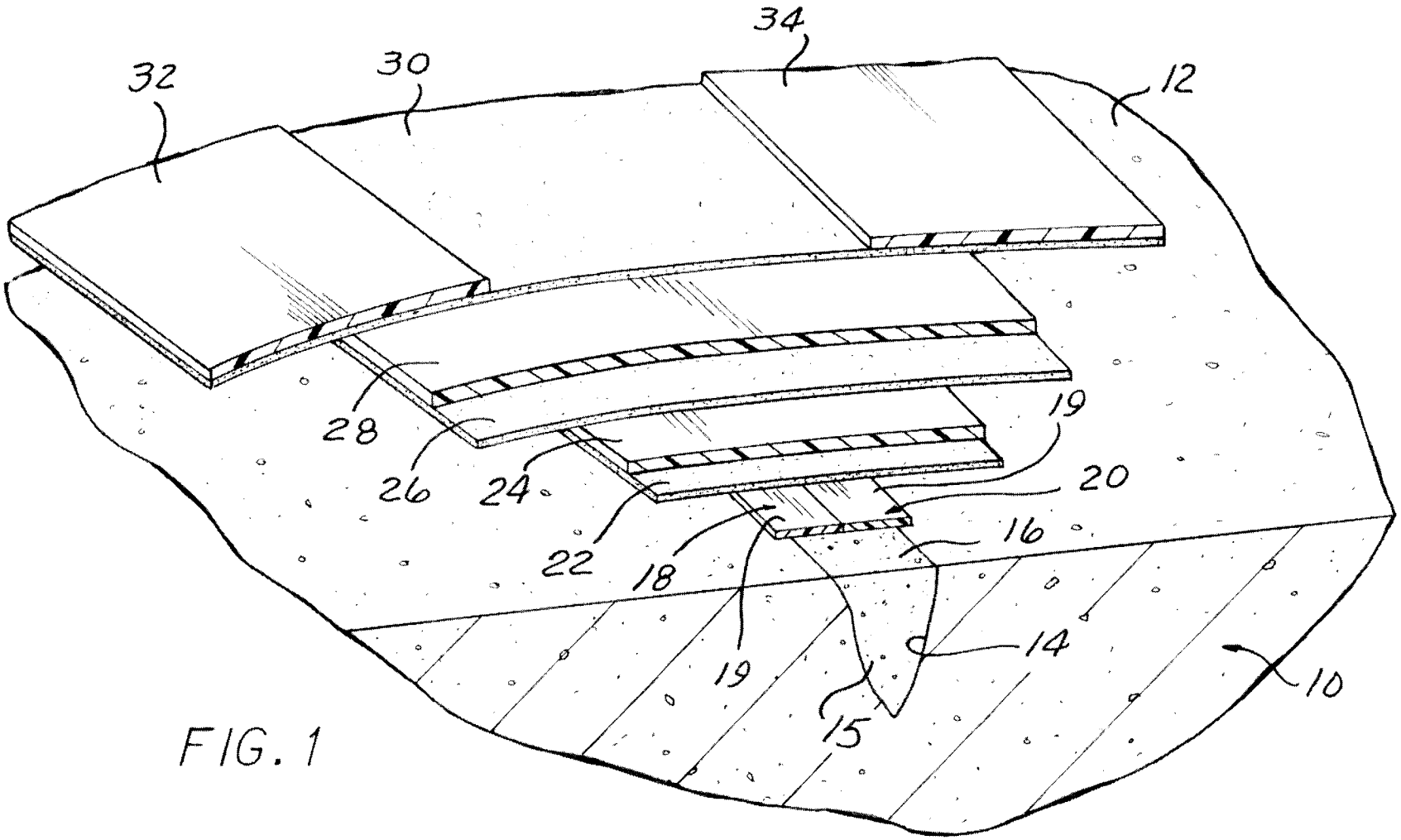
FIG. 1 is a broken-away, perspective, view of a repaired crack in a pavement surface using the crack repair method of the present invention.
Figure 2:
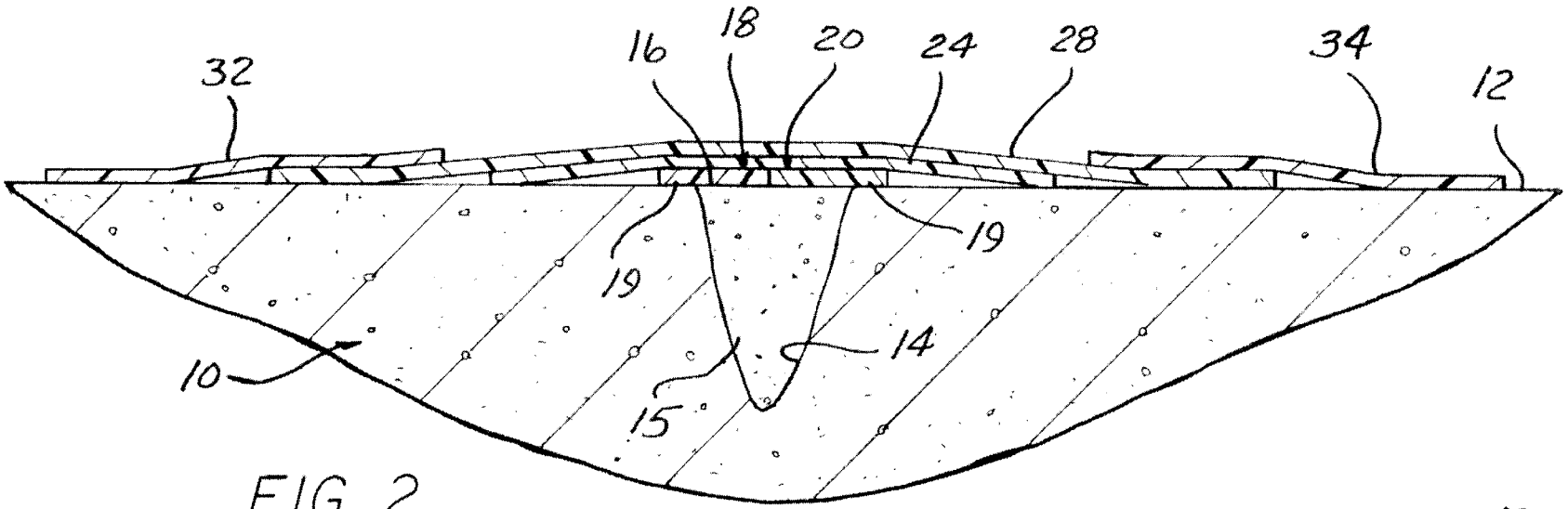
FIG. 2 is a lateral cross-sectional view through the repaired crack shown in FIG. 1, with the adhesive layers omitted for clarity.

Referring now to FIGS. 1 and 2, there are depicted the various layers in a crack repair effected by a crack repair method according to the present invention.

FIG. 1 depicts a typical section of pavement formed of concrete or asphalt found in a roadway, driveway, sidewalk or an outdoor recreational surface, such as a tennis court, basketball court, volleyball court, running track, etc. The pavement 10 has a certain thickness or layer buildup above an underlying base or ground, not shown. The pavement 10 has an exterior surface 12 in which a crack 14 has formed. The crack 14, as well as other cracks repairable by the crack repair method of the present invention, typically have different shapes, widths and lengths through the thickness of the pavement 10. Further, the crack 14 can extend from the top surface 12 to any depth through the thickness of the pavement 10, even completely through the thickness of the pavement 10 to the underlying base.

According to the crack repair method of the present invention, the first step is to clean the crack 14 of all loose pavement materials and other loose debris. This can be effected by brushing, hand removal, high pressure steam or water, suction, etc.

Once the crack 14 is completely clear of loose debris, a suitable crack filler material, which may include an epoxy binder, is poured into the crack 14 and allowed to harden thereby forming a top surface 16 substantially co-planar with the top surface 12 of the surrounding pavement 10. By way of example only, a crack filler material sold under the tradename "Novabond" or equivalent, is used to fill the crack 14.

After the crack filler 15 has hardened, a slip layer greater than four inches wide or at least five inches wide is centered over the crack 14 and extends outward from the sides of the crack 14 for a predetermined distance. A slip layer width of at least five inches has been found to cover substantially all cracks that can be repaired by the present method and forms a suitably wide slip layer for the overlying stretchable fabric layer or layers to increase the durability of the repair and lengthen it's useful life.

The slip layer can be formed of a single strip or two or more side-by-side strips. Thus, by example only, the slip layer is formed of: two three inch wide tape strips 18 and 20 which are applied side-by-side, adhesive side down, with the adjoining side edges centered over the filled crack 14. The shiny (i.e., polyethylene, Mylar, Teflon, etc.) coating on the outermost surface 19 of the two strips of tape 18 and 20 prevents any adherence of other materials or adhesive to the tape strips 18 and 20. However, the adhesive on the other side of the of tape strips 18 and 20 secures the tape strips 18 and 20 to top surface of the crack filler 15. It should also be noted that the use of at least two three inch wide tape strips or one five inch wide single tape strip significantly extends the area of coverage of the slip layer beyond the width of the crack 15 thereby ensuring that the tape strips 18 and 20 are joined to the surrounding top surface 12 of the pavement 10 for a considerable distance beyond the edges of the crack 14. The tape strips 18 and 20 extend beyond the length of the crack 14 by a small amount, i.e., three feet, in each lateral direction from the center of the crack.

The one or two tape strips 18 and 20 can be formed of a number of different tape or strip materials as long as one surface can carry adhesive or be adhesively joined to the pavement and an opposite surface is non-adhesively disposed relative to any overlaying layer, coating or sheet. For example, the slip layer can be formed of duct tape or other tapes formed of polyethylene, vinyl, polypropylene, ultra high molecular weight plastic, Mylar, Teflon, Delrin, etc.

In the next step of the present method, a first adhesive coating or layer 22, preferably formed of an acrylic adhesive, is applied over the tape strips 18 and 20, preferably centered on the adjoining edges of the tape strips 18 and 20. The first adhesive layer 22 is preferably applied in a twelve inch width centered on the crack 14 or the adjoining edges of the tape strips 18 and 20. In this manner, the adhesive extends four inches beyond the outer side edges of each of the tape strips 18 and 20 to provide a secure bond between the next adjacent sheet and the top surface 12 of the pavement 10. This is important when the next step in the present method is implemented. For clarity, all of the adhesive layers, including layer 22, are omitted in FIG. 2 due to the small thickness of each adhesive layer.

In the next step, a thin first sheet or layer of a stretchable, elastic sheet 24, also having an exemplary 12-inch width is applied centered over the crack 14 and substantially in line with the surface area covered by the first adhesive layer 22. By example only, the first sheet 24 is a stretchable fabric sheet, such as stitch bonded polyester sheet. As is known, a stitch bonded polyester sheet has a large number of parallel stitch lines extending along the length of the sheet. The first sheet 24, in one typical configuration, is about 0.014 inches thick. However, it will be understood that other thicknesses may also by employed.

Since the first sheet 24 has the same 12-inch width as the width of the first adhesive layer 22, approximately six total inches, including three inches of the first sheet 24, are adhered to the top surface 12 of the pavement 10 by the first adhesive layer 22 along each side edge of the adjoining tape strips 18 and 20. This leaves six inches of width of the unsecured stretchable fabric first sheet 24 overlaying the slip layer formed of the tape strips 18 and 20 which can expand and absorb any stresses due to crack growth or enlargement. The first sheet 24 extends at least two and preferably three feet beyond the longitudinal ends of the tape strips 18 and 20.

The crack repair of the present invention is now complete and can be painted over to match the color of the adjoining pavement surface. However, other optional steps may also be performed according to the present method to increase the strength and/or durability of the crack repair. In one aspect the method includes the application of a second adhesive layer 26, such as an acrylic adhesive, directly over the first sheet 24 and four inches beyond both of the side edges of the first sheet 24 as shown in FIG. 1.

Next, while the second adhesive layer 26 is still wet, a second layer of a 20-inch wide stretchable, elastic sheet 28 is applied over and centered on the 12-inch wide first sheet 24, with the ends extending at least two to about three feet beyond the ends of the first sheet 24. In this manner, four inches of the second sheet 28 are bonded to the top surface 12 of the pavement 10 beyond the side edges of the first sheet 24. This leaves twelve inches of the second sheet adhesively joined to the 12-inch wide first sheet 24, but isolated or delaminated from the filled crack on the tape strips 18 and 20 fixed to the top surface 12 of the pavement 10. The wider width of the second flexible sheet 28 also overlays and covers the edges of the narrower 12-inch wide first sheet 24.

It will be understood that while two or even more stretchable sheets 24 and 28 provide greater stretchability that increases the durability and useful life of crack repair, the same result may be obtained by use of only the first sheet 24, but in greater thickness than described above.

In addition, the stretchable sheets 24 or 28 can be formed of other stretchable materials, such as rubber, urethane, spandex, nylon, etc.

In another optional aspect, the method also includes the application of a third adhesive layer 30 directly over the 20-inch wide second sheet 28, about eight inches beyond each of the side edges of the second sheet 28 and up to the longitudinal ends of the second sheet 28. Finally, two 12-inch wide, 0.005 inch thick strips, 32 and 34, preferably formed of fiberglass fabric, are applied over the third adhesive layer 30 and both edges of the 20-inch wide second sheet 28. The strips 32 and 34 overlap the side edges of the second sheet 28 by four inches thereby causing the remaining eight inches of each strip 32 and 34 to be bonded directly to the top surface 12 of the pavement 10.

The strips 32 and 34 increase the surface area or grip of the crack repair patch to the pavement surface 12. As the repair is stressed due to crack enlargement and other structural forces, the wide strips 32 and 34 will decrease the chances of the repair delaminating from the top surface 12 of the pavement 10. In addition, since the strips 32 and 34 are significantly thinner than the first and second sheets 24 and 28, the strips 32 and 34 also help to hide the side edges of the first and second sheets 24 and 28 as well as to provide a smooth outer surface transition to the top surface 12 of the pavement 10.

Although it is time efficient to apply the third adhesive layer 30 in one pass, two separate 12 inch wide adhesive strips can be applied over each side edge of the second sheet 28, with four inches of each adhesive layer applied to the second sheet 28.

A short strip is similarly overlaid across each end of the third adhesive layer 30 to completely cover the edges of the second sheet 28.

It will also be understood that the fabric strips 32 and 34 can be applied over a crack repair including only the single sheet 24. In this aspect, the adhesive layer 30 is applied over the first sheet 24.

The progressive lengthening of each layer beyond the ends of the adjoining layer crates a tapered buildup with a gradual thinning toward the outer ends and side edges.

The key elements in the present crack repair method involve the use of the stretchable first and/or second sheets 24 and 28 which will stretch under crack movement without tearing. The significantly large area of the sheets 24 and 28 which is non-adhered to the top surface of the filled crack provides a large stretchable surface area sufficient to absorb significant elongation forces causes by crack growth or reformation. In addition, the stacked buildup of strips 18 and 20, the first and/or second sheets 24 and 28, and the optional outermost sheets 32 and 34 are delaminated or isolated from the filled crack at the center portion overlaying the slip layer, such as a slip layer formed of the tape strips 18 and 20. This allows the first and/or second sheets 24 and 28 to stretch in the area of non-adherence to the top surface 12 of the pavement 10.

Figure 3:
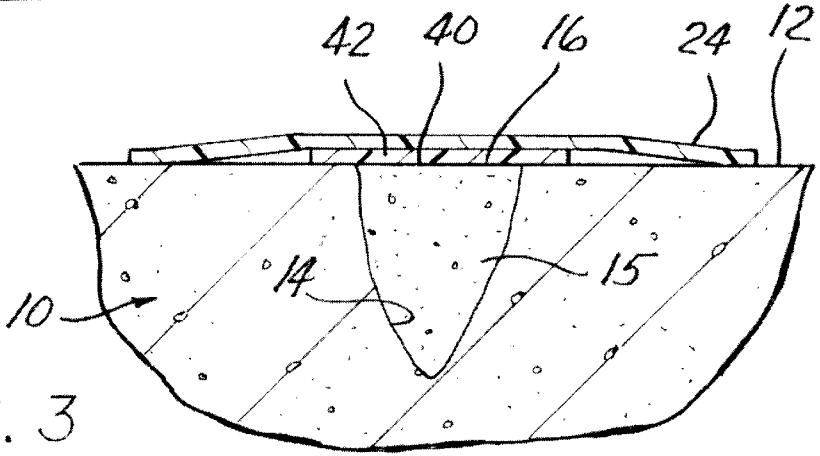
FIG. 3 is a partial, cross-sectional view showing a modification to the present inventive crack repair method.

Another modification to the present crack repair method is also possible, as shown in FIG. 3, by forming the slip layer of a single, at least five inch wide plastic film or tape 42 which is carried on the bottom surface of the first stretchable sheet 24 and is centered over the filled crack 15. The plastic sheet or tape 42 is fixed on an inner surface to the first sheet 24 by adhesive, co-extrusion or other bonding techniques. Any of the tapes described above can be used to form the sheet 42.

In this modified method, a first layer of adhesive 40 is applied over the filled crack 15 for six inches to either side of the center of the crack 15 for a total application width of twelve inches. The first sheet 24 having the plastic sheet 42 adhered to a back surface is then applied over the first adhesive layer 40 with the plastic sheet 42 contacting the adhesive 40. However, the smooth outer surface of the sheet 42 does not adhere to the adhesive 40 thereby allowing the center eight inches of the first sheet 24 to stretch under stresses caused by crack growth or reformation. The outer two inches along each side edge of the first sheet 24 are adhesively bonded to the top surface 12 of the pavement 10 by the adhesive 40.

In summary, there has been disclosed a unique crack repair method which provides a wide slip-sheet or layer between a filled crack in a pavement and at least one or more overlaying stretchable sheets which are adhesively joined to each other and separately to the top surface of the pavement by overlapping edges. In one aspect, the slip-layer is provided by a plastic sheet or tape carried on the back surface of the first sheet which is capable of exhibiting sliding movement over the surface of the filled crack.

What is claimed is:

1. A method of repairing a crack in a pavement surface comprising the steps of:

cleaning the crack of debris;

filling the crack with a crack filler hardenable to a solid state;

applying a solid slip sheet over the filled crack and for a predetermined distance beyond each side of the crack, the slip sheet being greater than four inches wide with one surface adhesively fixed over the filled crack and the pavement and a non-adherable surface on an opening side facing away from the filled crack;

applying a first adhesive layer over the slip sheet and for a first distance beyond side edges of the slip sheet;

applying a first sheet of stretchable material over and in contact with the first adhesive layer;

applying a second adhesive layer over the first sheet of stretchable material to a second distance on a pavement surface beyond the edges of the first sheet; and applying a second sheet of stretchable material over and in contact with the second adhesive layer so that outer edges of the second sheet extend to a full second distance of application of the second adhesive layer on the pavement surface.

2. The method of claim 1 further comprising the steps of:

forming a width of the slip sheet and a width of the first and second sheets such that the side edges of the first and second sheets extend progressively further laterally outward from the side edges of the slip sheet.

3. The method of claim 1 further comprising the step of:

forming the second sheet with a width dimension wider than the corresponding width dimension of the first sheet.

4. The method of claim 1 further comprising the step of:

forming a width dimension of the first sheet wider than a width dimension of the slip sheet.

5. The method of claim 1 further comprising the step of:

forming the first and sheet of a material selected from the group consisting of stitch bonded polyester, rubber, urethane, nylon and spandex.

6. The method of claim 1 further comprising the step of:

the width of application of the second adhesive layer and with the second sheet of stretchable material are selected such that side edges of the second sheet extend laterally beyond side edges of the first sheet.

7. The method of claim 6 wherein the side edges of the second adhesive layer and the side edges of the second sheet project at least four inches beyond the side edges of the first sheet.

8. The method of claim 1 further comprising the steps of:

forming a width of application of the first adhesive layer and a width of the first sheet of stretchable material such that the side edges of the first sheet of stretchable material project laterally outward from side edges of the slip sheet.

9. The method of claim 8 wherein the side edges of the application width of the first adhesive layer and the side edges of the first sheet of stretchable material project at least three inches laterally beyond side edges of the slip sheet.

10. The method of claim 1 wherein the slip sheet is formed of at least two side-by-side strips.

11. A method of repairing a crack in a pavement surface comprising the steps of:

cleaning the crack of debris;

filling the crack with a crack filler hardenable to a solid state;

applying a solid slip sheet over the filled crack and for a predetermined distance beyond each side of the crack, the slip sheet being greater than four inches wide with one surface adhesively fixed over the filled crack and the pavement and a non-adherable surface on an opposing side facing away from the filled crack;

applying a first adhesive layer over the slip sheet and for a first distance beyond side edges of the slip sheet;

applying a first sheet of stretchable material over the first adhesive layer;

applying a second adhesive layer over the first sheet of stretchable material to a second distance beyond the edges of the first sheet;

applying a second sheet of stretchable material over the second adhesive layer to the full second distance of application of the second adhesive layer;

applying a third adhesive layer over the second sheet to a third distance beyond the second sheet; and applying two outermost strips, one over one edge of the second sheet wherein the two outermost strips are bonded to the second sheet and to the top surface of the pavement beyond the side edges of the second sheet by the third adhesive layer.

12. The method of claim 11 further comprising the step of:

applying the third adhesive layer in an application width which extends beyond the side edges of the second sheet; and providing the two outermost strips in a width such that each strip overlays a side portion of the second sheet and extends outward to the full application width of the third adhesive layer.

13. The method of claim. 12 wherein the width of the two outermost sheets is at least twelve inches; and the third adhesive layer applied in a width to extend at least eight inches outward from each side edge of the second sheet.

14. The method of claim 11 further comprising the step of:

forming the two outermost strips of fiberglass fabric.

15. The method of claim 11 further comprising the steps of:

applying laterally extending end strips over each longitudinal end of the second sheet and the third adhesive layer between opposed ends of the two outermost strips.

16. A method of repairing a crack in a pavement surface comprising the steps of:

cleaning the crack of debris;

filling the crack with a crack filler hardenable to a solid state;

applying a solid slip sheet over the filled crack and for a predetermined distance beyond each side of the crack, the slip sheet being greater than four inches wide with one surface adhesively fixed over the filled crack and the pavement and a non-adherable surface on an opposing side facing away from the filled crack;

applying a first adhesive layer over the slip sheet and for a first distance beyond side edges of the slip sheet;

applying a first sheet of stretchable material over the first adhesive layer;

applying another adhesive layer over the first sheet to a distance beyond the side edges of the first sheet; and applying two outermost strips, one over each side edge of the first sheet wherein the two outermost sheets are bonded to the first sheet and to the top surface of the pavement beyond the side edges of the first sheet by the another adhesive layer.

17. The method of claim 16 further comprising the step of:

forming a length of each of the slip sheet and the first and second sheets such that the longitudinal ends of the slip sheet and the first and second sheets extend progressively in a buildup direction beyond the longitudinal ends of the crack.

* * * * *